US007001001B1

(12) United States Patent
Spencer

(10) Patent No.: US 7,001,001 B1
(45) Date of Patent: Feb. 21, 2006

(54) CABINET

(75) Inventor: James M. Spencer, LaPorte, IN (US)

(73) Assignee: A & A Sheet Metal Products, Inc., LaPorte, IN (US)

( * ) Notice: Subject to any disclaimer, the term of this patent is extended or adjusted under 35 U.S.C. 154(b) by 0 days.

(21) Appl. No.: 10/233,882

(22) Filed: Sep. 3, 2002

(51) Int. Cl.
*E05B 65/46* (2006.01)

(52) U.S. Cl. ..... 312/219; 312/326; 312/329; 312/283; 312/286; 49/95

(58) Field of Classification Search ..... 312/326, 312/329, 283, 286, 287; 49/95, 96, 104; 232/43.1; 292/DIG. 71
See application file for complete search history.

(56) References Cited

U.S. PATENT DOCUMENTS

| | | | | |
|---|---|---|---|---|
| 1,603,404 | A | 10/1926 | Procter | |
| 1,632,683 | A | 6/1927 | Tracy | |
| 3,174,193 | A | 3/1965 | Smith | |
| 3,602,536 | A | 8/1971 | Gamble | |
| 3,764,190 | A * | 10/1973 | Anderson | 312/286 |
| 4,011,686 | A | 3/1977 | Jett, III et al. | |
| 4,360,991 | A * | 11/1982 | West | 52/29 |
| 5,358,322 | A * | 10/1994 | McLaughlin | 312/219 |
| 5,533,798 | A * | 7/1996 | Feldpausch et al. | 312/219 |
| 5,788,348 | A * | 8/1998 | Ramachandran et al. | 312/223.1 |
| 5,988,778 | A * | 11/1999 | Lammens | 312/217 |
| 6,079,216 | A | 6/2000 | de Marsillac Plunkett | |
| 6,457,278 | B1 * | 10/2002 | Fleming | 52/37 |
| 6,484,531 | B1 * | 11/2002 | Hambleton et al. | 62/440 |
| 2001/0028208 | A1 * | 10/2001 | Reilly | 312/286 |
| 2003/0151337 | A1 * | 8/2003 | Leccia et al. | 312/326 |

OTHER PUBLICATIONS

Securall, "Safety Cabinet with Interlocking Doors", Jun. 7, 2001, 1 page.
Securall, "Custom Cabinet Quote", Jun. 29, 2001, 2 pages.
Performance Contracting Inc., "Purchase Order No. 5089–0003", Jul. 31, 2001, 1 page.
A&A Sheet Metal Products, Inc., "Storage Cabinet for Flammable and Combustible Liquids", Aug. 9, 2001, 2 pages.
A&A Sheet Metal Products, Inc., "Securall Safety Storage Equipment", Aug. 13, 2001, 5 pages.
MHM Associates, "A&A Dwg. No. 986, "Custom 3412" cabine", Aug. 31, 2001, 3 pages.
Eagle USA Airfreight, "Transport Document: Local Control No. 20238360", Sep. 19, 2001, 1 page.

* cited by examiner

*Primary Examiner*—Peter M. Cuomo
*Assistant Examiner*—Erika Garrett
(74) *Attorney, Agent, or Firm*—Baker & Daniels LLP

(57) ABSTRACT

A cabinet includes at least two doors located on opposite sides of the cabinet. The cabinet includes an interlocking means comprising a pair of release mechanisms, locking mechanisms, and latching mechanism. The latching mechanism functions to retain the doors in the closed position unless activated by an operator, allowing the doors to be opened. The locking mechanism prevents the latching mechanism from being activated when the opposing door is open. The release mechanism communicates the position of the door to the locking mechanism associated with the other door.

12 Claims, 10 Drawing Sheets

CABINET

BACKGROUND OF THE INVENTION

1. Field of the Invention

The present invention relates to cabinets. In particular, the present invention relates to cabinets having at least two doors and a mechanism that prevents one of the doors from being opened when the other door is open.

2. Description of Prior Art

Cabinets having an interlock for doors, which prevents the opening of both doors at the same time, are known and have been used in various industries. One example of this type of mechanism is disclosed in U.S. Pat. No. 4,011,686 to Jett, III, which discloses a transfer chamber including a rocker arm, which may be rocked between a first door locking position and a second door locking position. If the rocker arm is in the first door locking position, opening the second door causes the top edge of the door to engage a latch flange on the rocker arm, thereby preventing the rocker arm from rocking. This retains the first door in a closed position.

Another patent disclosing an invention similar in nature is U.S. Pat. No. 1,632,683 to Tracy, which discloses an automatic entrance protector for a vestibule having doors arranged in pairs. Each pair of doors is arranged such that when a first door is opened, the paired door automatically locks, preventing the opening of both doors at the same time. This locking is accomplished through a series of pivoting levers, which communicates the movement of the first door to a locking mechanism associated with the second door.

Additionally, other patents describe a two-door locking mechanism, such as U.S. Pat. No. 3,602,536 to Gamble, U.S. Pat. No. 3,174,193 to Smith, and U.S. Pat. No. 1,603,404 to Proctor.

SUMMARY OF THE INVENTION

A cabinet according to one embodiment of the present invention includes a frame, a first set of doors and a second set of doors attached to the frame, each of the first and the second set of doors including at least two individual doors, and means for retaining the first set of the doors in the closed position when at least one door of the second set of doors is opened.

In another embodiment of the invention, the cabinet further includes a release mechanism and a locking mechanism. The release mechanism has a channel with a first end and a second end, a body located in the channel and having a first end and a second end, and a first means for biasing the body toward the second end of the channel. The locking mechanism has a channel and a locking member pivotally connected to the channel, the locking member having a first end and a second end, and a second means for biasing the locking member. The locking mechanism cooperates with the release mechanism such that opening one door of the second set of doors activates the locking mechanism which in turn locks the first set of doors in the closed position.

The cabinet may also include a latching mechanism for retaining the doors of the first set of doors in the closed position. In one embodiment, the latching mechanism includes an opening and the body of the release mechanism and the locking member are positioned such that the first end of the body contacts the second end of the locking member and one of the doors of the second set of doors contacts the second end of the body when that door is closed. Opening that door causes that door to disengage the second end of the body, which in turn causes the body to move away from the first set of doors, thereby allowing the locking member to pivot such that the first end of the locking member engages the opening. Closing that door causes the second end of the body to pivot the locking member such that the first end of the locking member disengages the opening. The latching mechanism may include a pivot arm, a latching arm, and a sliding member having an opening positioned such that movement of the sliding member pivots the pivot arm, which in turn causes movement of the latching arm so as to disengage the latching mechanism and permit the first door to be opened.

According to another embodiment of the invention, a cabinet includes a first door having a latching mechanism, a second door, a release mechanism having a body with a first end and a second end, and a locking member having a first end and a second end. The locking member is positioned such that when the second door is closed, the second door contacts the first end of the body, causing the second end of the body to contact the first end of the locking member. This causes the locking member to pivot so as to allow movement of the latching mechanism such that the first door may be opened. The locking member is positioned such that when the second door is opened the first end of the body no longer contacts the first end of the locking member. This causes the locking member to pivot such that the second end engages the latching mechanism and prevents the first door from being opened.

In one embodiment, the release mechanism includes a channel with the body mounted therein so as to be movable. The body includes an opening in the body. A bolt extends through the opening and connects the body to the cabinet. Contact between the bolt and the opening limits movement of the body.

Other features of the present invention will be apparent to those skilled in the art from the following detailed description of the preferred embodiments and accompanying drawings.

DETAILED DESCRIPTION OF EMBODIMENTS OF THE INVENTION

The embodiments of the invention described herein are not intended to be exhaustive, nor to limit the invention to the precise forms disclosed. Rather, the embodiments selected for description have been chosen to enable one skilled in the art to practice the invention.

Figure 1:
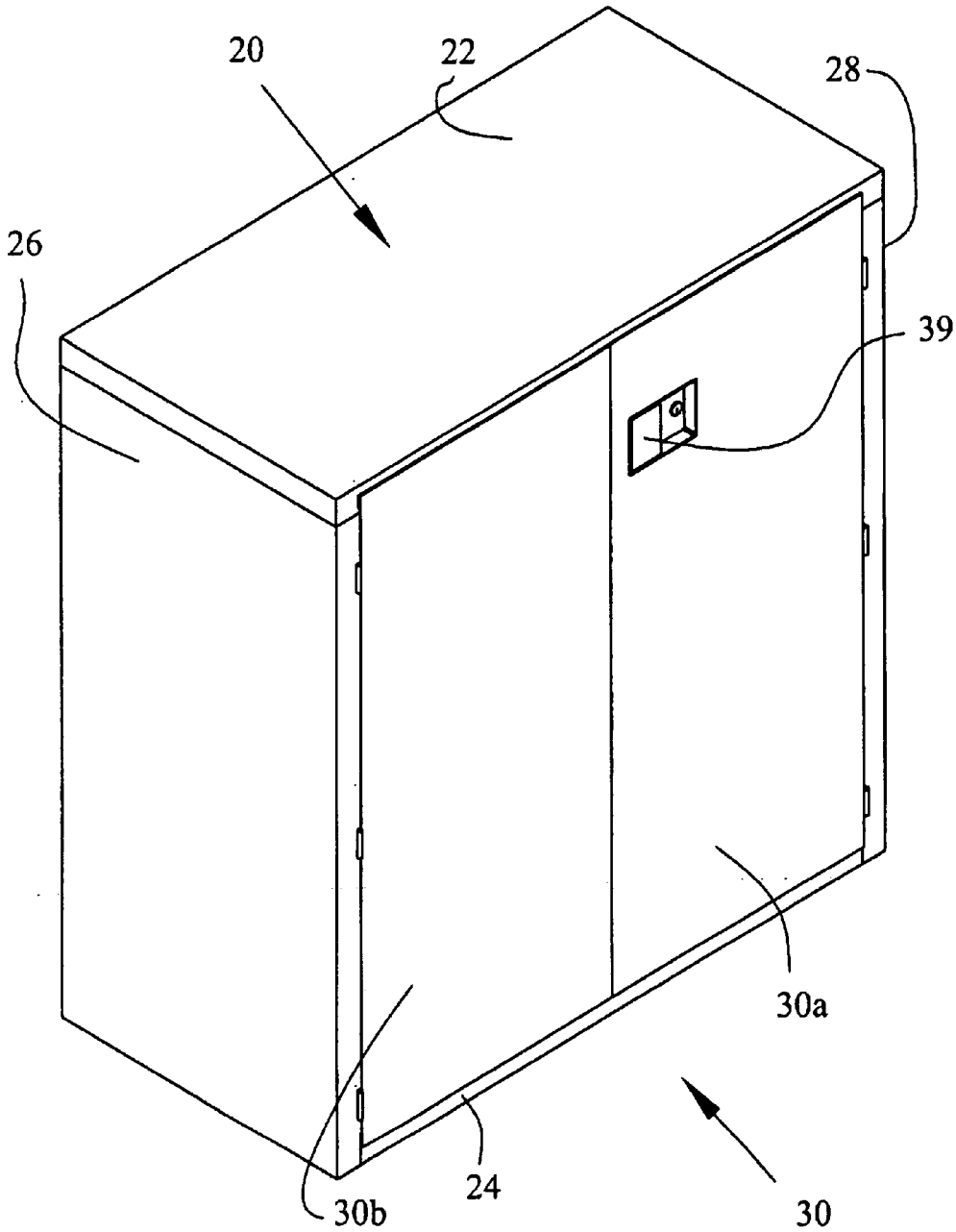
FIG. 1 is a perspective view of a cabinet in accordance with one embodiment of the present invention.
Figure 2:
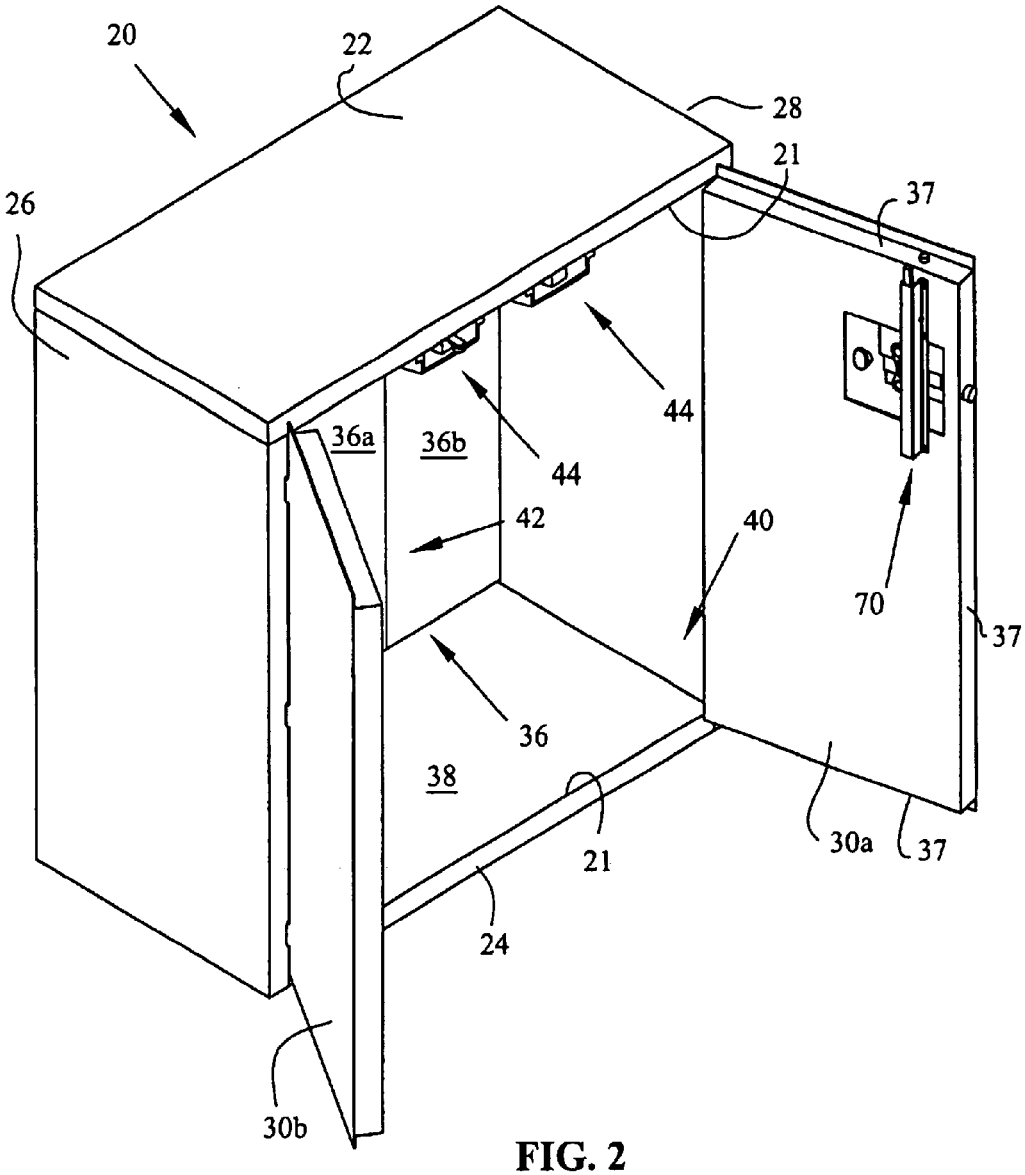
FIG. 2 is a perspective view of the cabinet shown in FIG. 1, with one set of double doors in the open position.

Referring now to FIGS. 1 and 2, a cabinet is shown and generally indicated by numeral 20. Cabinet 20 includes top 22, bottom 24, first side 26 and second side 28. Lips 21 extend along the open sides of top 22 and bottom 24. Cabinet 20 further includes a first set of doors 30 including door 30*a* and 30*b* and a second set of doors 36 including doors 36*a* and 36*b*. Doors 30*a* and 36*a* each include a handle 39. Doors 30, 36 in this embodiment are located on opposing sides of cabinet 20.

Referring now to FIG. 2, a perspective view of storage cabinet 20 is shown with the first set of doors 30 opened to allow access to interior 38. As can be seen in this view, a first opening 40 and a second opening 42 both allow access into interior 38 from the exterior of cabinet 20. Generally, the first set of doors 30 conceal first opening 40 when closed; with the second set of doors 36 concealing second opening 42 while closed.

Referring still to FIG. 2, generally indicated by numeral 44 are a plurality of release mechanisms affixed to top 22 in the manner described below. A pair of locking mechanisms, generally indicated by numeral 70 (one shown) are affixed to doors 30*a* and 36*a*.

Figure 3:
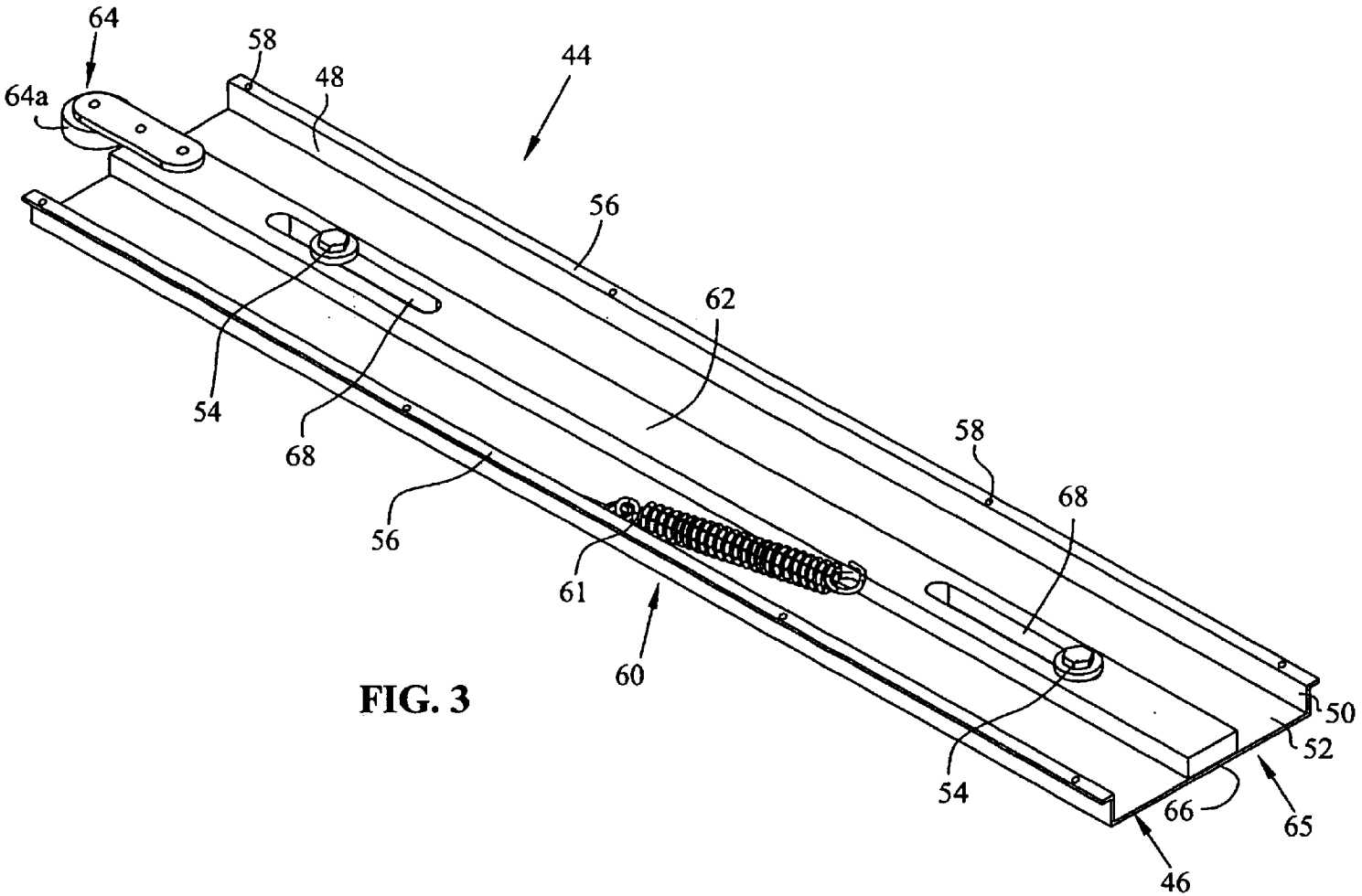
FIG. 3 is a perspective view of a release mechanism that is a component of the cabinet of FIG. 1.
Figure 4:
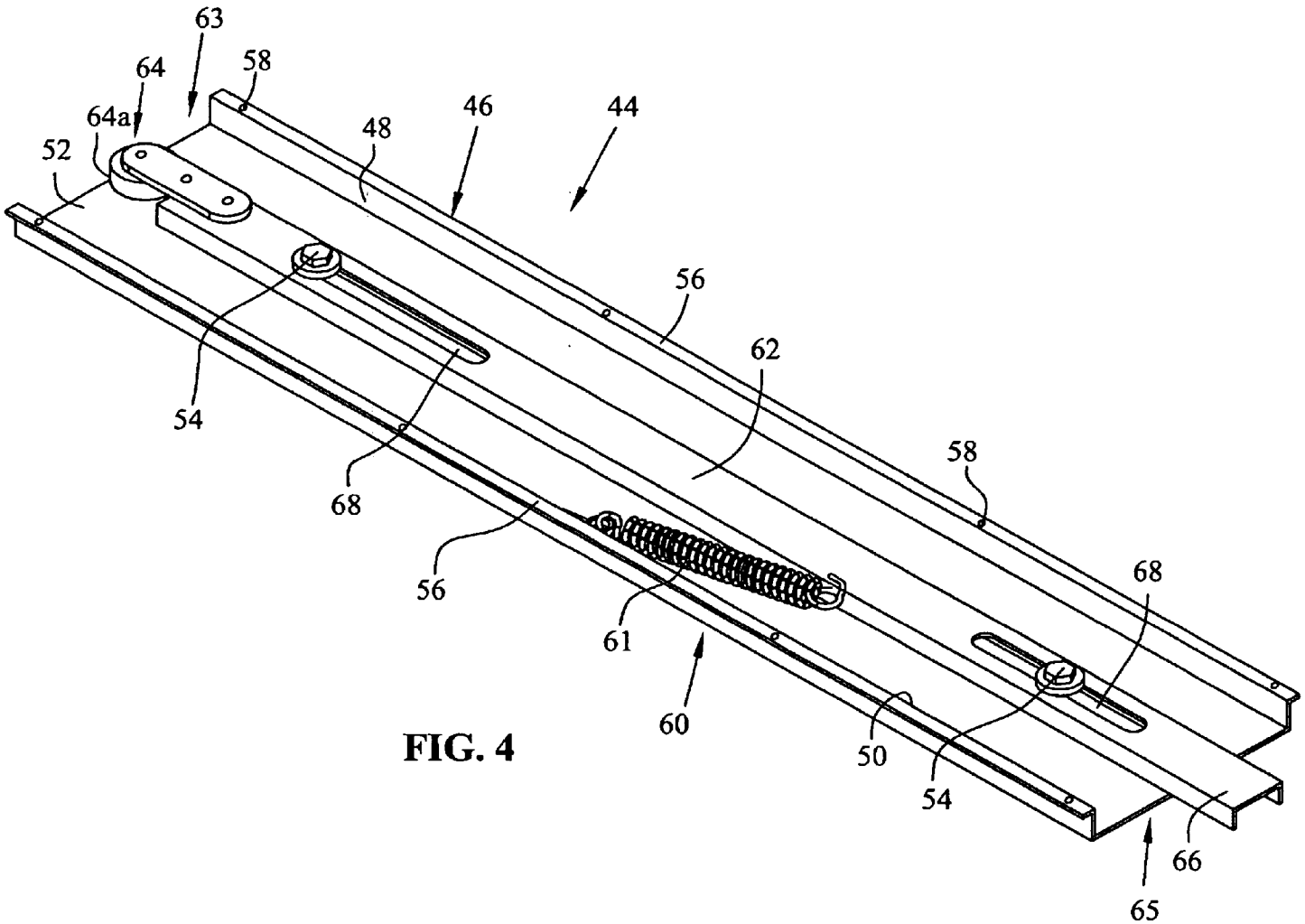
FIG. 4 is a perspective view of the release mechanism shown in FIG. 3 in the activated position, as if the mechanism were in contact with a closed set of double doors.

Referring now to FIGS. 3 and 4, release mechanism 44 is shown and includes a channel, general indicated by numeral 46, a plurality of bolts 54, biasing means 60 and body 62. Channel 46 includes first side wall 48 and second side wall 50 connected by planar portion 52. In this embodiment, planar portion 52 has a substantially rectangular shape with a width that is greater than that of body 62 and a length which is less than that of body 62. First side wall 48 and second side wall 50 extend above planar portion 52 and above body 62, bolts 54 and biasing means 60. Extending parallel to planar portion 52 from the side walls 48, 50 are a plurality of flanges 56, which include a plurality of mounting holes 58. Channel 46 also includes a first end 63 and a second end 65.

Referring still to FIGS. 3 and 4, extending longitudinally through channel 56 is body 62. Generally, body 62 has a length which exceeds that of channel 46, and a width generally less than that of channel 46. Body 62 includes a first end 64 having, in the embodiment shown, a roller 64*a*, a second end 66, and a plurality of openings 68. The interaction of bolts 54 and openings 68 limit the travel of body 62 within channel 46, as described below. In this embodiment, bolts 54 extend through openings (not shown) in planar portion 52 and further extend through openings 68. Bolts 54 are then affixed via a nut (not shown) so as to retain body 62 in channel 46.

Roller 64*a* may be affixed to body 62 in any number of ways well known. Second end 66 is located opposite roller 64*a* on body 62. As should be apparent to one possessing ordinary skill in the art, a roller, or the like, may also be affixed to end 66 if so desired.

Biasing means 60 biases body 62 toward first end 63 and away from second end 65, as shown in FIG. 3. Biasing means 60 may be any of a number of known means, such as spring 61 shown in this embodiment. One end of spring 61 is affixed to channel 46 and the opposite end of spring 61 is affixed to body 62. As body 62 is moved toward second end 65, spring 61 extends, thereby creating a force upon body 62 and biasing body 62 toward first end 63. Further, when no external force is exerted upon body 62, the force exerted by spring 61 moves body 62 toward first end 63 of channel 46 until one bolt 54 contacts an opening 68, as is shown in FIG. 3. FIG. 4 shows the location of body 62 within channel 46 when one of doors 30*b* or 36*b* is closed and contacts roller 64*a* (not shown). Note that the other bolt 54 limits movement of body 62 in this direction.

Figure 5:
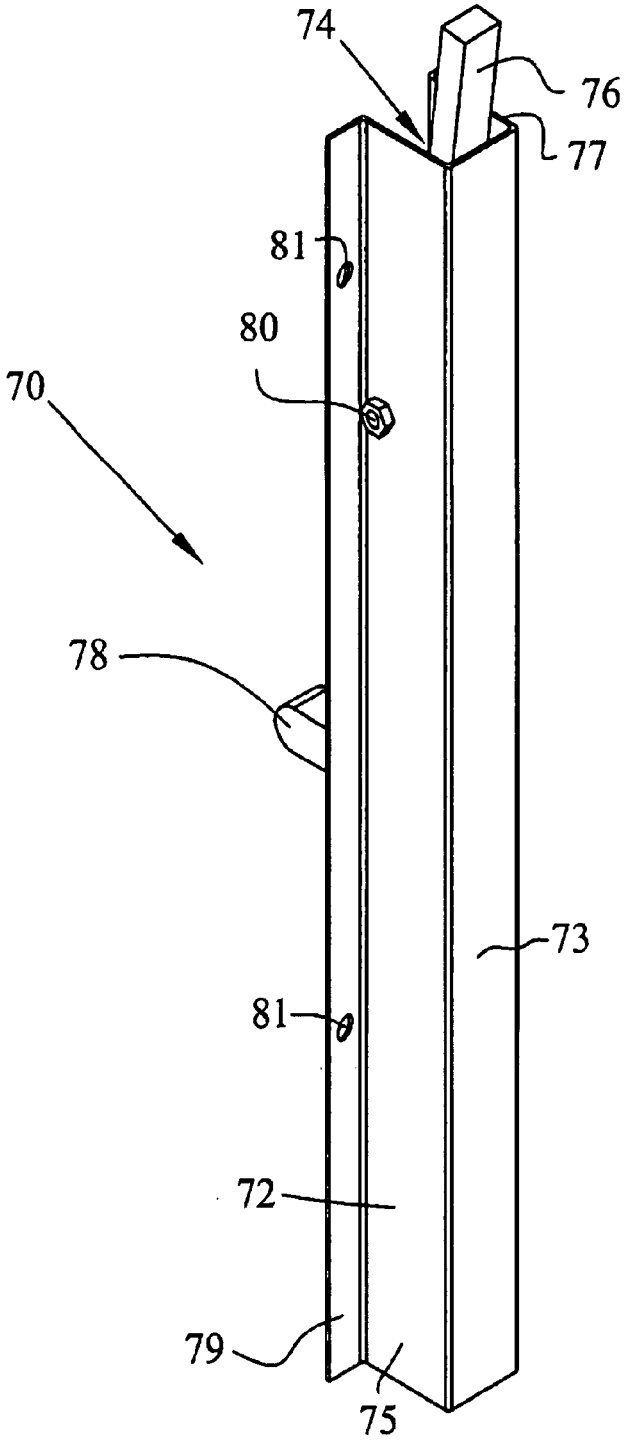
FIG. 5 is a perspective view of a locking mechanism that is a component of the cabinet of FIG. 1.

Referring now to FIG. 5, a locking mechanism 70 is shown detached from door 30*a* or 36*a*. Locking mechanism 70 includes a channel generally indicated by numeral 72 and a locking member 74. Channel 72 includes a planar portion 73, a first side wall 75, and a second side wall 77. First side wall 75 and second side wall 77 both extend from opposing edges of planar portion 73 as shown. Extending perpendicularly from first side wall 75, and located parallel to planar portion 73, is a flange 79. Flange 79 includes a plurality of mounting holes 81 spaced at intervals throughout. A second flange (not shown) extends from second side wall 77 in a manner similar to that of flange 79 from first side wall 75.

Located between first side wall 75 and second side wall 77 is locking member 74. Referring now to both FIGS. 5 and 6, bolt 80 extends through locking member 74, first side wall 75, and second side wall 77 providing a pivot about which locking member 74 may rotate. In addition, bolt 80 functions as a means for retaining locking member 74 within locking channel 72 and between the side walls 75, 77.

Figure 6:
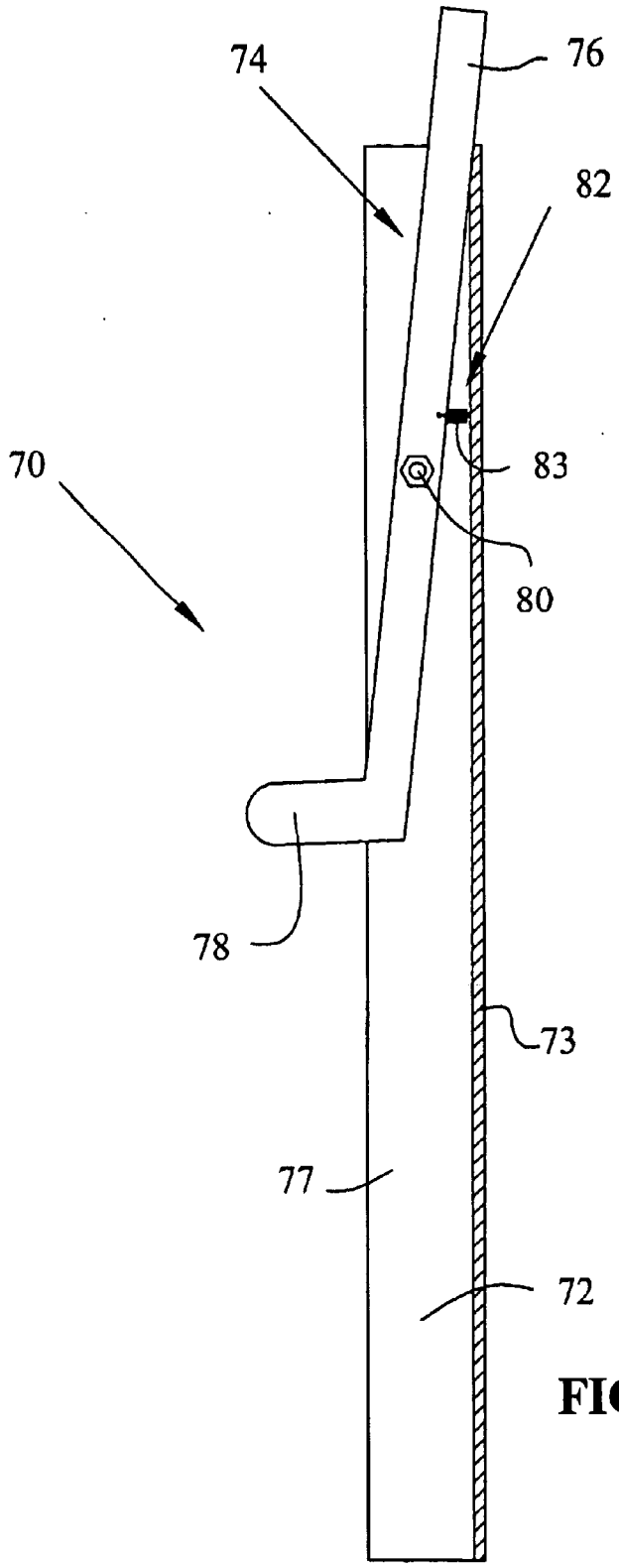
FIG. 6 is a sectional side view of the locking mechanism shown in FIG. 5.

As is seen more clearly in FIG. 6, locking member 74 includes first end 76 and second end 78. Further, as is shown in FIG. 6, a second biasing means, generally indicated as numeral 82, is attached between locking member 74 and planar portion 73 of channel 72. In this embodiment, second biasing means 82 is spring 83, which biases first end 76 toward planar portion 73 of channel 72 and second end 78 away from planar portion 73. Although spring 83 is disclosed as a biasing means, any other means capable of biasing locking member 74 in a manner consistent with that described above may be substituted for spring 83.

Figure 7:
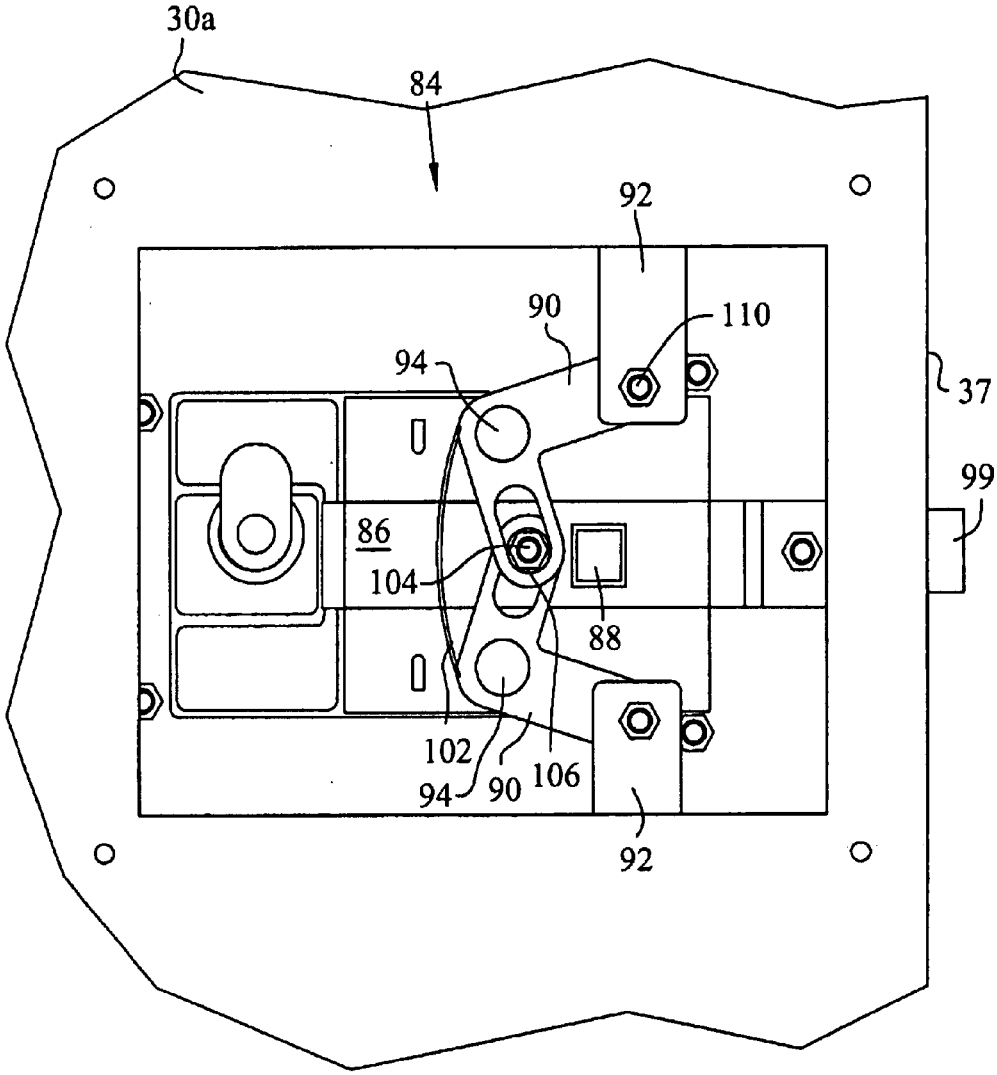
FIG. 7 is a plan view of a latching mechanism that is a component of the cabinet shown in FIG. 1.

Referring now to FIG. 7, a latching mechanism, generally indicated by numeral 84, is shown. Latching mechanism 84 includes sliding member 86, a plurality of pivot arms 90, and a plurality of latching arms 92. Sliding member 86 can move toward and away from the edge 37 of door 30*a*. Sliding member 86 includes opening 88 and locating knob 104. Opening 88 has a shape that allows insertion of second end 78 of locking member 74 into opening 88.

Pivotally attached to sliding member 86 are pivot arms 90. Any number of pivot arms may be attached to sliding member 86 while still maintaining the spirit of the present invention. Pivot arms 90 include locating openings 106 that receive locating knob 104. Arms 90 are pivotable about connections 94. Connections 94 may be of any type well known sufficient to provide pivot arms 90 with a pivot point about which they may rotate. Locating knob 104 should reside within openings 106 such that movement of sliding member 86 causes knob 104 to contact the edges of openings 106, thereby causing arms 90 to pivot about connection 94. In the present embodiment, two pivot arms are employed, each being located on opposing sides of sliding member 86.

Figure 8:
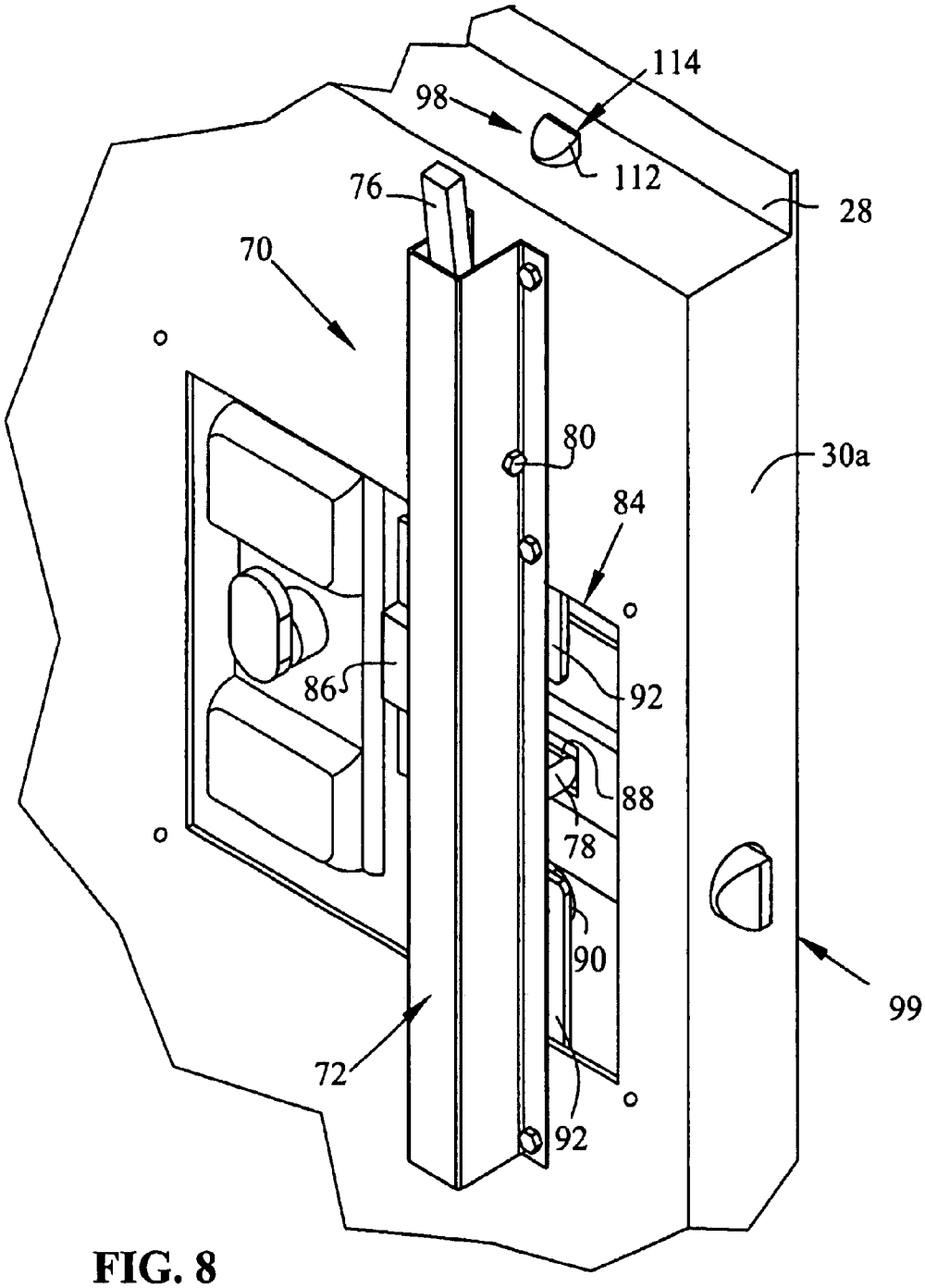
FIG. 8 is a perspective view of the locking mechanism shown in FIG. 5 and the latching mechanism shown in FIG. 7 attached to a door of the cabinet shown in FIG. 1.

Attached to pivot arms 90 opposite openings 106 are latching arms 92, which may be affixed via any manner allowing a pivotable connection. In the present embodiment, a bolt and nut combination 110 is employed as the pivot connection. Latching arm 92 is connected to a latching member 98 at the end opposite pivot arm 90, as is shown in FIG. 8. Latching member 98 may be of any type well known in the art. In this embodiment, latching member 98 includes a sloped surface 112 and flat surface 114. Sloped surface 112 allows latching member 98 to retract as door 30*a* is closed.

As door 30*a* is closed, sloped surface 112 comes into contact with lips 21 of cabinet 20 and is forced within door 30*a*. Once door 30*a* has been moved into the fully closed position, latching member 98 extends such that surface 114 is in contact with the opposite side of lips 21, preventing door 30*a* from being opened unless latching member 98 is retracted into door 30*a*. Another latch member 99 affixed to sliding member 86 functions in a similar fashion.

Referring to both FIGS. 7 and 8, a biasing means 102 is shown for biasing pivot arms 90 about pivotal connection 94 in a manner such that the latching members 98 attached to the latching arms 92 extend through the door 30*a*.

To open door 30*a*, handle 39 is pivoted, which causes sliding member 86 to move away from edge 37 in a known manner. This causes latching member 99 to move into edge 37. Movement of member 86 also causes knob 104 to contact the edges of openings 106, thereby causing arms 90 to pivot about connection 90 and draw arms 92 toward member 86. As arms 92 move, they pull latching members 98 in the same direction, thereby disengaging members 98 from the frame of cabinet 20.

Figure 9:
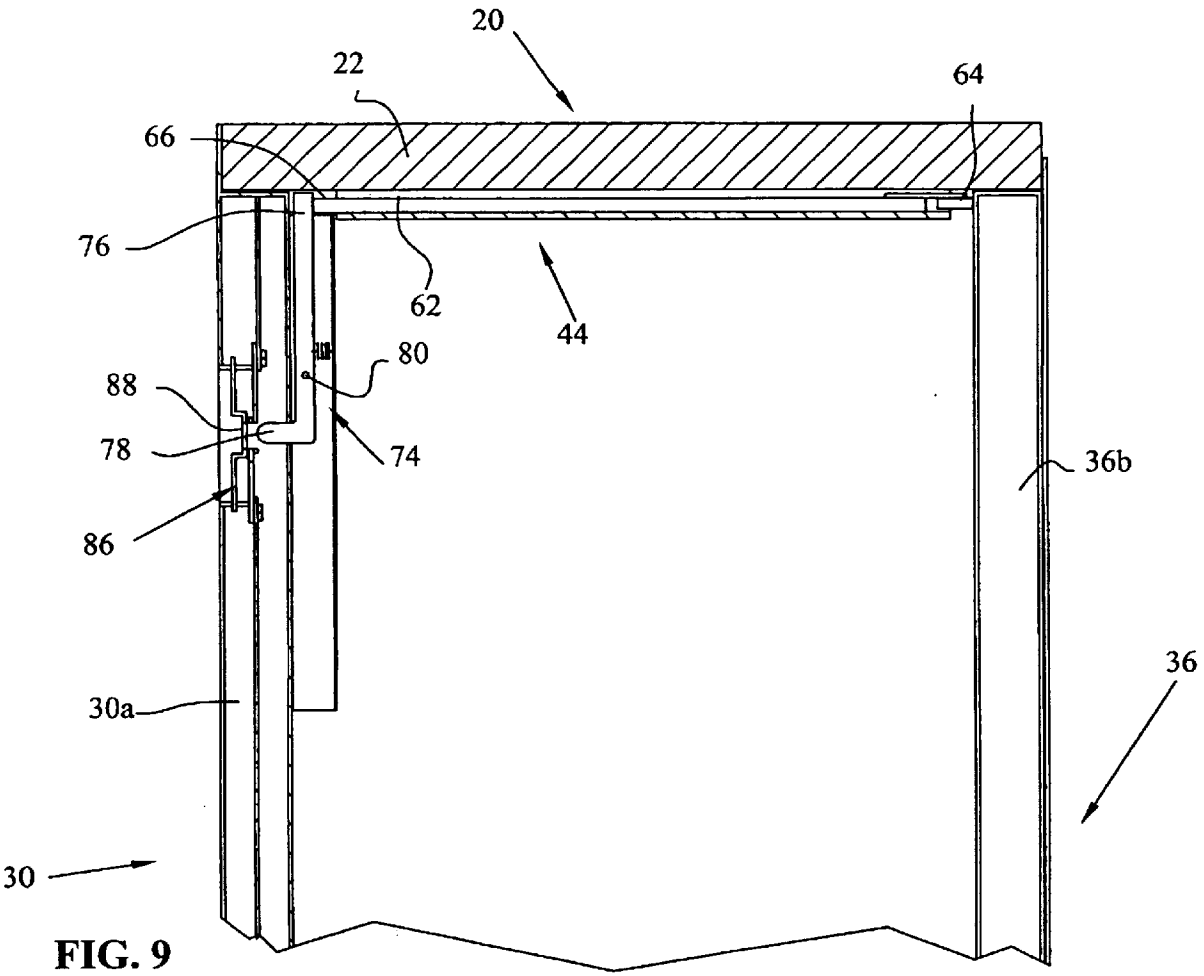
FIG. 9 is a sectional view of the cabinet shown in FIG. 1.
Figure 10:
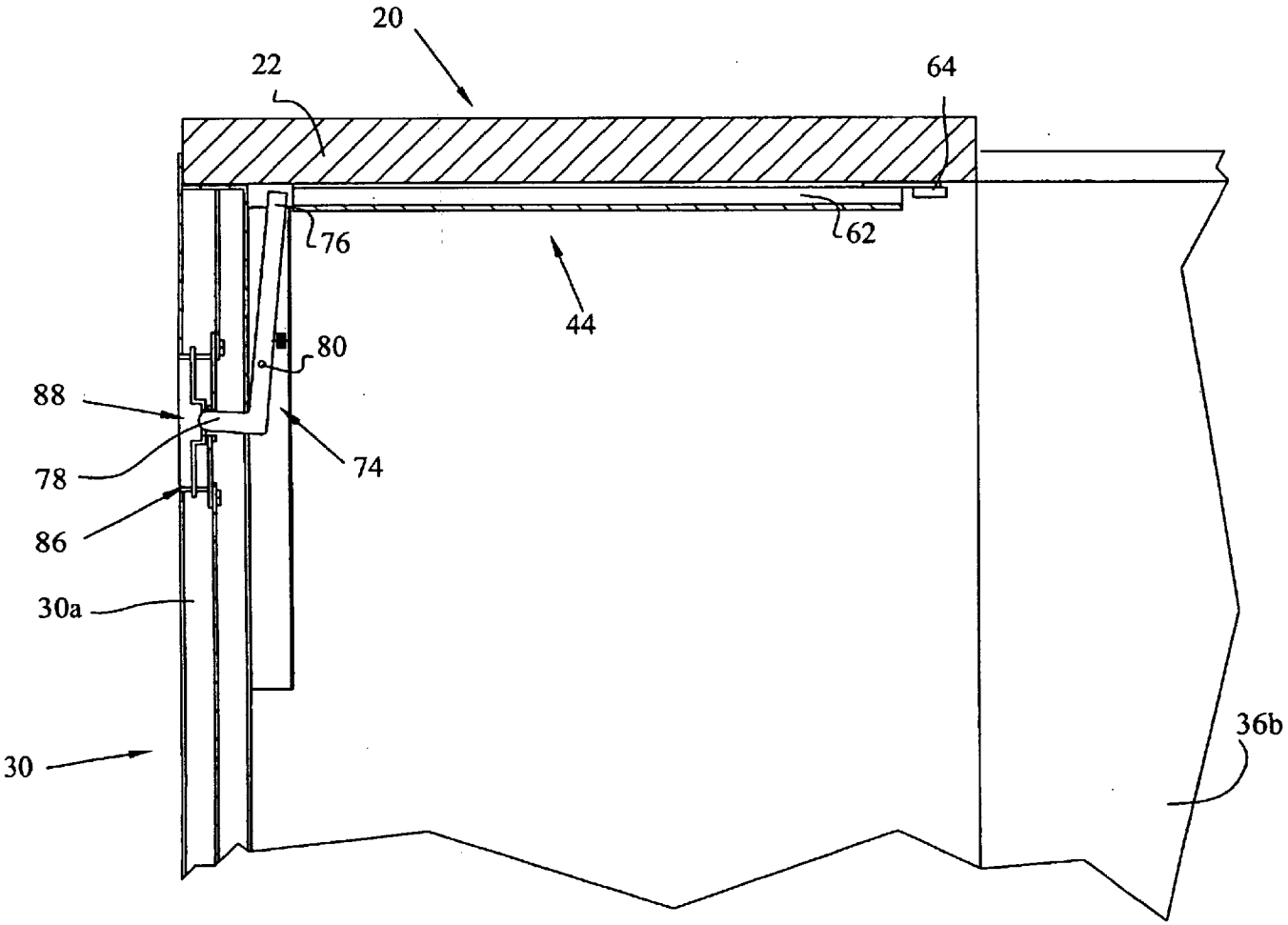
FIG. 10 is a sectional view of the cabinet shown in FIG. 2.

Referring now to FIGS. 9 and 10, a sectional view of cabinet 20 is shown. FIG. 9 shows cabinet 20 with both sets of doors 30, 36 closed. In contrast, FIG. 10 shows a sectional view with second set of doors 36 opened and first set of doors 30 closed. Referring first to FIG. 9, door 30*a* of first set of doors 30 is shown located opposite door 36*b* of second set of doors 36. Affixed to top 22 of cabinet 20 is release mechanism 44, with roller 64*a* in contact with door 36*b*. The contact between door 36*b* and roller 64*a* pushes second end 66 of body 62 into contact with end 76 of locking member 74. This contact causes locking member 74 to pivot about bolt 80, withdrawing second end 78 from aperture 88. In this manner, sliding member 86 can slide freely. As such, sliding member 86 may be moved into a position, as described above, wherein the latching members 98 and 99 are withdrawn into door 30*a*, allowing door 30*a* to be opened.

Referring now to FIG. 10, cabinet 20 is shown with second set of doors 36 opened while first set of doors 30 remain closed. As can be seen in this figure, when second set of doors 36 are opened, door 36*b* is no longer in contact with roller 64*a* as described above. This causes body 62 to move toward second end 65 of channel 46 under the force of biasing means 60. As this occurs, locking member 74 rotates about bolt 80 under the force of biasing means 82. This causes end 78 of locking member 74 to engage opening 88 in member 86. As discussed above, insertion of second end 78 into opening 88 prevents movement of sliding member 86, thereby preventing door 30*a* from being opened, as the latching members 98 and latch 99 are prevented from being withdrawn into door 30*a*.

As discussed above, this same combination of release mechanism 44 and locking mechanism 70 is present between door 36*a* and door 30*b*. In this instance, opening door 30*b* prevents door 36*a* from being opened. Consequently, only one set of doors 30, 36 may be opened at a time, as opening either set will prevent the opening of the opposing doors in the manner set forth above.

While this invention has been described as having an exemplary design, the present invention may be further modified within the spirit and scope of this disclosure. The application is, therefore, intended to cover any variations, uses, or adaptations of the invention using its general principles and equivalents. Further, this application is intended to cover such departures from the present disclosure as come within known or customary practice in the art to which this invention pertains.

I claim:

1. A cabinet, including:

a frame;

a first set of doors and a second set of doors attached to the frame, each of the first and the second set of doors including at least two individual doors; and means for retaining the first set of the doors in the closed position when at least one door of the second set of doors is opened wherein the means for retaining includes:

a release mechanism having a channel with a first end and a second end, a body located in the channel and having a first end and a second end, and a first means for biasing the body toward the second end of the channel;

a locking mechanism having a channel and a locking member pivotally connected to the channel, the locking member having a first end and a second end, and a second means for biasing the locking member; and wherein the locking mechanism cooperates with the release mechanism such that opening one door of the second set of doors activates the locking mechanism which in turn locks the first set of doors in the closed position.

2. The cabinet of claim 1, wherein the first end of the body contacts at least one door of the second set of doors when that door is closed.

3. The cabinet of claim 1, wherein the first means for biasing is a spring.

4. The cabinet of claim 1, wherein the second means for biasing is a spring.

5. The cabinet of claim 1, wherein the first set of doors includes a latching mechanism for retaining the doors of the first set of doors in the closed position.

6. The cabinet of claim 5, wherein the latching mechanism includes an opening and wherein the body of the release mechanism and the locking member are positioned such that:

the first end of the body contacts the second end of the locking member and one of the doors of the second set of doors contacts the second end of the body when that door is closed;

opening that door causes that door to disengage the second end of the body, which in turn causes the body to move away from the first set of doors, thereby allowing the locking member to pivot such that the first end of the locking member engages the opening; and closing that door causes the second end of the body to pivot the locking member such that the first end of the locking member disengages the opening.

7. The cabinet of claim 5, wherein the latching mechanism includes a pivot arm, a latching arm, and a sliding member having an opening positioned such that movement of the sliding member pivots the pivot arm, which in turn causes movement of the latching arm so as to disengage the latching mechanism and permit the first door to be opened.

8. A cabinet, including:

a first door having a latching mechanism;

a second door;

a release mechanism having a body with a first end and a second end; and a locking member having a first end and a second end, the locking member positioned such that when the second door is closed, the second door contacts the first end of the body causing the second end of the body to contact the first end of the locking member and pivot the locking member so as to allow movement of the latching mechanism such that the first door may be opened.

9. The cabinet of claim 8, wherein the locking member is positioned such that when the second door is opened the first end of the body no longer contacts the first end of the locking member, thereby causing the locking member to pivot such that the second end engages the latching mechanism and prevents the first door from being opened.

10. The cabinet of claim 8, wherein the release mechanism includes:

a channel with the body mounted therein so as to be movable;

an opening in the body;

a bolt extending through the opening and connecting the body to the cabinet; and wherein contact between the bolt and the opening limits movement of the body.

11. The cabinet of claim 8, further including a spring for biasing the second end of the locking member toward the first door.

12. The cabinet of claim 8, wherein the latching mechanism includes a pivot arm and a sliding member having an opening, the pivot arm being affixed to the sliding member and the latching arm, whereby movement of the sliding member causes movement of the pivot arm, which in turn causes movement of the latching arm.

* * * * *